United States Patent [19]

Minami et al.

[11] 4,437,974

[45] Mar. 20, 1984

[54] COAL LIQUEFACTION PROCESS

[75] Inventors: Ryohei Minami, Chiba; Shozo Okamura; Yoshihiko Sunami, both of Ibaraki; Takuji Hosoi, Kawasaki; Takuo Kanou, Tokyo, all of Japan

[73] Assignee: Sumitomo Metal Industries, Ltd., Osaka, Japan

[21] Appl. No.: 389,566

[22] Filed: Jun. 17, 1982

[30] Foreign Application Priority Data

Jun. 29, 1981 [JP] Japan ..... 56-99647

[51] Int. Cl.[3] ..... C10G 1/06

[52] U.S. Cl. ..... 208/10

[58] Field of Search ..... 208/10

[56] References Cited

U.S. PATENT DOCUMENTS 2,115,336 4/1938 Krouch et al. ..... 208/10
4,224,137 9/1980 Schroeder ..... 208/10
4,229,283 10/1980 Sosnowski ..... 208/10 X
4,299,685 11/1981 Khulfe et al. ..... 208/10
4,345,989 8/1982 Vernon et al. ..... 208/10
4,345,990 8/1982 Fahlström et al. ..... 208/8 R

*Primary Examiner*—William G. Wright
*Attorney, Agent, or Firm*—Burns, Doane, Swecker & Mathis

[57] ABSTRACT

A coal liquefaction process and apparatus therefor are disclosed. According to this invention, a finely divided coal and a solvent are contacted with molecular hydrogen in the presence of a catalyst to provide a slurry, the slurry is separated into a gaseous component, a liquid component and a solid residue, the solid residue which is the liquefaction residue is then supplied to a molten metal bath together with oxygen gas to generate a gas entraining fine powdery solids, and the thus recovered fine powdery solids are returned to the liquefaction process as a catalyst.

17 Claims, 1 Drawing Figure

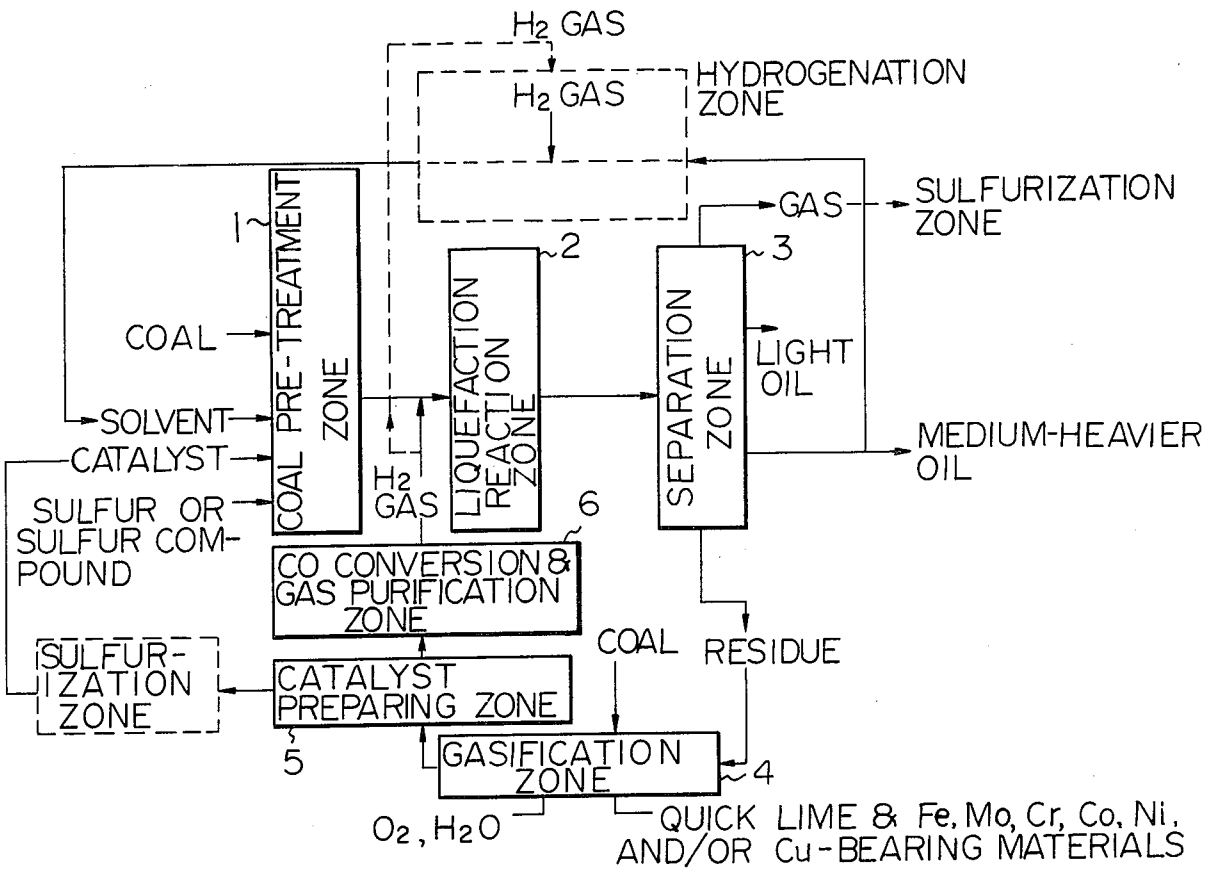
HYDROGENATION ZONE
SULFURIZATION ZONE
MEDIUM-HEAVIER OIL
H2 GAS
H2 GAS
GAS
3
LIGHT OIL
SEPARATION ZONE
RESIDUE
4
QUICK LIME & Fe, Mo, Cr, Co, Ni, AND/OR Cu-BEARING MATERIALS
COAL
2
6
LIQUEFACTION REACTION ZONE
CO CONVERSION & GAS PURIFICATION ZONE
CATALYST PREPARING ZONE
GASIFICATION ZONE
O2, H2O
H2 GAS
COAL PRE-TREATMENT ZONE
1
5
COAL
SOLVENT
CATALYST
SULFUR OR SULFUR COMPOUND
SULFURIZATION ZONE

COAL LIQUEFACTION PROCESS

This invention relates to a coal liquefaction process and an apparatus therefor in which a finely divided coal and solvent are contacted with hydrogen gas in the presence of a catalyst. More particularly, it relates to a coal liquefaction process and an apparatus therefor within which an inexpensive, highly active catalyst is recovered and reused.

The principle of liquefaction of coal by adding hydrogen to coal so as to convert it to oil components has been known for a long time. However, the reaction wherein hydrogen is added to coal proceeds slowly, so the liquefaction is usually carried out at an elevated temperature in the range of 400° to 500° C. and at a hydrogen pressure in the range of 100 to 300 kg/cm$^2$ or higher.

The feasibility of a coal liquefaction process largely depends on the following two factors:

(1) The reaction should be carried out at the lowest possible temperature and pressure in order to minimize the power cost.

(2) Hydrogen is expensive, so it should be reacted with the coal as efficiently as possible, and the amount of hydrogen which is consumed to form gases and water should be minimized or eliminated.

Thus, in order to facilitate efficient utilization of hydrogen and also to carry out the liquefaction reaction under less severe conditions including temperature, pressure and so forth, various catalysts have been proposed.

Two types of catalyst are used for coal liquefaction. One is an iron-disposable catalyst having medium low activity. The other is a highly active Mo- or Co-based catalyst to be used in a boiled bed-type reactor.

The process utilizing the former catalyst is called the "Bergius Process" and has been commercially applied in Germany. This process involves liquefying coal in the presence of an iron-based catalyst and a solvent under pressurized hydrogen at 300 kg/cm$^2$ or above. The coal liquids thus produced are isolated by any suitable solid-liquid separation techniques such as distillation, centrifugal separation or gravitational sedimentation, and the used catalyst is discharged out of the system along with the solid residue formed in the reaction. This method is advantageous in that the catalyst is free of degradation usually caused by coking and so on because the used catalyst is discarded. However, such inexpensive, disposable catalysts as iron ores and red mud have low activity and must be added in large amounts—on the order of 5% by weight, for example—based on the coal. Therefore, using them means higher costs for transportation from their source such as mines and for pulverization prior to use as a catalyst, and such increase in costs adds to the cost of the coal liquefaction products.

The H-coal process developed in the United States is an example of the process utilizing the latter type of catalyst. The H-coal process involves liquefaction in a boiled bed in the presence of a highly active Mo-Ni-$Al_2O_3$ system catalyst as a hydrogenation catalyst. One of the advantages of this process is that a large amount of lighter oil of high quality is produced in a rather efficient manner because of the high catalytic activity of the catalyst and an increased hydrogenation rate. However, the loss of some catalyst due to attrition and a decrease in catalytic activity due to deposition of metals and coking cannot be avoided. Therefore, part of the catalyst is withdrawn and passed to a regeneration step. However, since the catalyst cannot be regenerated completely, fresh catalyst containing expensive metals such as molybdenum and nickel must be added secondarily, which also leads to an increase in cost of the coal liquid products.

As stated above, the existing coal liquefaction processes using a catalyst involve the following two problems:

(1) A disposable iron-based catalyst exhibiting low catalytic activity requires long-distance transportation from the mine or other source and a pulverizing operation, and it is discarded after it has once passed through the process. These disadvantages add to the cost of the final products.

(2) A more active catalyst of Mo-Ni system is expensive and loses activity due to coking when it is used for a long period of time, and it is necessary to employ a regeneration step and to supply fresh catalyst to make up for the catalyst lost. This also adds to the cost of the products.

Accordingly, an inexpensive catalyst of a high activity for use in a coal liquefaction process is still desired. Even in case a highly active catalyst is provided, its activity is inevitably lost due to coking and deposition of metals and long life of the catalyst cannot be expected. Therefore, it is also desired that the catalyst used be one that can be recovered and regenerated as completely as possible.

In coal liquefaction processes, it is desirable that the hydrogen which is used in the process be generated by the process itself. Usually, hydrogen is produced by gasifying the residue left after coal liquefaction or by speparating hydrogen from the off gas formed in the liquefaction step.

The production of hydrogen gas by gasification of the liquefaction residue has been studied in various ways, and the Texaco gasification process and the Lurgi process, for example, have been proposed in the United States. The Texaco gasification process comprises gasifying coal or liquefaction residue at an elevated pressure in a fluidized bed in the presence of oxygen or steam (water vapor), while the Lurgi process employs a pressurized fixed-bed column in which the coal supplied through the vapor rock hopper is gasified with oxygen or steam blown into the column at the bottom thereof.

Other gasification processes have also been proposed or developed. For example, Japanese Patent Laid-Open specification No. 89395/1980 (July 5, 1980) discloses that coal is injected into a molten metal bath together with pressurized oxygen (oxygen jet) to effect gasification of the coal (this process is hereinafter referred to as "metal bath gasification process").

In these gasification processes, the resulting gas is generally purified, after dust removal, by removing $H_2S$, $NH_3$ and the like and then subjecting to carbon monoxide conversion reaction to concentrate the hydrogen.

Particularly, in the above-mentioned metal bath gasification process, since the produced gas entrains considerable amounts of the metal and slag on the order of 50 g/Nm$^3$ in all due to evaporation and spitting, it is necessary to pass the gas through wet dust removing equipment such as Venturi scrubber or dry dust removing equipment such as a cyclone or bag filter. In addition, because of its fineness, it is quite difficult to inject or otherwise introduce the thus recovered dust into the molten metal bath in order to recycle and reuse it in the gasification step. As a result, a considerable amount of dust is inevitably produced as a by-product, which is a serious problem of the metal bath gasification process.

Accordingly it is an object of this invention to provide an improved coal liquefaction process and apparatus therefor which eliminate the above-mentioned problems of the prior art processes by combining the coal liquefaction process with the gasification process.

Another object of this invention is to provide an inexpensive, highly active catalyst for coal liquefaction.

A further object of this invention is to provide a coal liquefaction process in which the liquefaction residue is gasified to generate a gas according to the metal bath gasification process and a large amount of dust entrained by the thus produced gas is introduced to the liquefaction step as a catalyst.

The accompanying drawing is a schematic flow diagram of an embodiment of this invention.

In summary, this invention resides in a coal liquefaction process comprising a coal liquefaction step to contact finely divided coal with molecular hydrogen and a solvent in the presence of a catalyst to provide a slurry, and a separation step to separate the resulting slurry into a gaseous component, a liquid component and a solid residue, characterized by further comprising a metal bath gasification step to gasify a carbonaceous solid material by blowing an oxygen gas and said solid residue onto a molten metal bath through a non-immersing lance, and fine powdery solids recovered from the thus generated gas in said metal bath gasification step being introduced to said liquefaction step and used as said catalyst.

This invention also resides in a coal liquefaction apparatus which comprises a coal pre-treatment zone in which the coal to be treated is finely divided, a liquefaction reaction zone in which said finely divided coal is contacted with molecular hydrogen and a solvent in the presence of a catalyst to provide a slurry, a separation zone in which the resulting slurry is separated into a gaseous component, a liquid component including light oil and medium heavier oil, and a solid residue, a metal bath gasification zone in which oxygen gas and the solid residue which contains a carbonaceous solid material are blown onto a molten metal bath through a non-immersing lance to gasify said carbonaceous solid material, and a catalyst-preparing zone in which fine powdery solids are recovered from the gas generated in said metal bath gasification zone and are introduced to said liquefaction reaction zone as said catalyst.

Thus, according to this invention, the fine powder entrained by the gas formed in the metal bath gasification process is recovered and used as a catalyst for the coal liquefaction process itself within the system of this invention, and the preparation of the catalyst does not require any substantial cost. In addition, since the powder entrained by the produced gas and used as a catalyst in accordance with this invention is fine particles not greater than several ten microns in diameter, there is no need to pulverize them prior to use. For example, when a molten iron bath is used as a metal bath, iron vapor is formed at the fire point at which an oxygen jet impinges against the surface of the molten metal bath. The temperature of the metal at the fire point is said to be at least 2000° C., and part of the iron vapor reacts with the sulfur-containing component in the residue to form iron sulfide, which is, as will be detailed hereinafter, effective as a coal liquefaction catalyst. Thus, the fine powder entrained by the gas produced by the metal bath gasification process is enriched with catalytically active components such as iron and sulfur, and it possesses a high specific surface area due to its fine particulate nature. Therefore, the thus recovered fine powder exhibits markedly high reducing activity. In addition, it also possesses cracking activity, because it contains $SiO_2$, etc. in addition to iron and sulfur. In the cases where a bath of another metal such as Cu, Mo, Cr, Ni or Co is used, the catalytic activity of the entrained fine powder will be further improved since such metals exhibit higher hydrogenation activity than iron. From a practical viewpoint, however, it is advisable to use a molten iron or steel bath which may contain at least one of Mo, Cr, Ni, Co and Cu. The amount of each element to be incorporated in the metal bath may be varied depending on the degree of catalytic activity required.

An additional great advantage of the process of this invention is that, after the fine powder serves as a catalyst in the liquefaction step, the thus once used catalyst is passed along with the liquefaction residue to the metal bath gasification step, where it can be reused as a metal source for the metal bath gasification furnace to provide "newly" generated fine powder, which can be called "regenerated catalyst". Thus, the metal bath gasification furnace can function not only as a furnace for preparing a catalyst for coal liquefaction but also for regenerating the used catalyst.

It will be understood that the process of this invention has a great advantage particularly in the cases where the catalyst used contains an expensive metal or metals such as Mo, W, Ni, Co, Cu and Cr. Thus, in accordance with a preferred embodiment of this invention, it is advisable to use a molten steel bath containing at least one of these elements, and after such catalyst which contains one or more expensive and highly active metals such as Mo, W, Ni, Co, Cr, etc. is used as a catalyst in the liquefaction reactor, it is passed together with the liquefaction residue to a metal bath gasification furnace, in which it is decomposed into individual elemental metals and recovered as such in the bath. The recovered metals constitute a part of the bath. A portion of the thus recovered metals is then evaporated at the fire point or splashed into droplets and the vapor and droplets coming from the bath may be collected for reuse as a highly active catalyst. In this manner, the process provides for efficient utilization of the expensive metal-containing catalyst.

In summary, using the fine powder formed in the metal bath gasification as a coal liquefaction catalyst offers the following advantages:

(1) The catalyst is supplied in the process itself and no transportation cost is necessary.

(2) There is no need for pulverization because the catalyst is generated in fine particulate form.

(3) It exhibits high catalytic activity as a coal liquefaction catalyst because it has been reduced at an elevated temperature, contains sulfur and has a large specific surface area.

(4) After use, it is recovered in the metal bath furnace and can be reused. This is particularly advantageous and effective in the cases where the catalyst contains one or more expensive and highly active metals such as Mo, W, Ni and Cu.

In order to further enhance the catalytic activity, it is preferred to increase the sulfur content of the powder, since such metals as Fe, Mo, Ni, W and the like exert their catalytic activities in the form of sulfides. This purpose may be accomplished by adding elemental sulfur or a sulfur-containing compound along with the fine powder catalyst in the liquefaction step. Alternatively, the fine powder may previously be reacted with elemental sulfur or a sulfur-containing compound to sulfurize the catalyst prior to use as a catalyst. The sulfur-containing compound may be either gaseous or liquid and includes hydrogen sulfide, carbonyl sulfide, carbon disulfide, mercaptan and the like.

The gaseous sulfur-containing compound may be diluted with a suitable diluent gas such as hydrogen, carbon monoxide or nitrogen. Therefore, it is, of course, possible to use as the source of sulfur-containing compound a hydrogen sulfide-containing hydrogen gas formed in the liquefaction step or in the subsequent hydrogenation step as an off-gas.

Preferably, the sulfurization of the fine powder may be effected, for example, by keeping a mixture of the fine powder and the elemental sulfur (the weight ratio is 1:1) at a temperature of 800° C. or below in a hydrogen atmosphere.

The fine powder used as a catalyst is usually added in an amount of approximately 0.01% to 20%, preferably approximately 0.1% to 3% by weight based on the dry coal regardless of whether it is used alone or in a sulfurized form, although the more, the better. When the fine powder is added together with elemental sulfur or a sulfur-containing compound to the coal liquefaction reactor, the weight ratio of sulfur to fine powder may range from about 0.1 to about 2. Also in the case of sulfurization, the fine powder may be reacted so as to render it to contain sulfur in a weight ratio of sulfur to fine powder in the range of 0.1 to 2.

Now this invention will be further described in conjunction with the accompanying drawing, in which a schematic view of a preferred embodiment of this invention is shown.

As is apparent from the schematic view, the coal liquefaction apparatus of this invention comprises a coal pretreatment zone 1, a liquefaction reaction zone 2, a separation zone 3, a gasification zone 4 and a catalyst-preparing zone (i.e. fine powder-recovering zone) 5. Thus, according to this invention, a finely divided coal is prepared in said pre-treatment zone 1 and the resulting powdery coal is contacted with molecular hydrogen and a solvent in the presence of a catalyst. In the drawing, the solvent and catalyst are combined with the coal in the coal pre-treatment zone 1. The thus prepared mixture of coal, solvent and catalyst is subjected to the liquefaction reaction in the presence of molecular hydrogen in the liquefaction reaction zone 2. The resulting slurry from the zone 2 is then passed to the separation zone 3 where the slurry is separated into a gaseous component, a liquid component and a solid component. From the liquid component lighter oils and medium heavier oils may be recovered separately. The thus obtained medium heavier oils may be used as a solvent to be supplied to the coal liquefaction zone with or without hydrogenation. The off-gas may be used as a sulfur source to be used for sulfurization of catalyst. The solid component, which is the coal liquefaction residue, is passed to the metal bath gasification zone comprised of a heating furnace which contains a molten metal, preferably molten iron or steel bath. Quick lime and preferably Fe-, Mo-, Cr-, Co-, Ni- or Cu-bearing material is supplied to the zone 4. If necessary, coal may be added to the molten metal bath. The addition of steam is desirable so as to generate hydrogen gas. The resulting gas entraining fine powder is then passed to the catalyst-preparing zone where the fine powder is separated from the gas, which is then purified at the subsequent CO conversion and gas-purification zone 6 to provide hydrogen gas. The thus obtained hydrogen gas may be used as molecular hydrogen to be incorporated in the coal liquefaction zone. It may also be passed to said hydrogenation zone.

Each of the processing zones will be further detailed hereinafter one by one.

In the coal pretreatment zone, coal and a catalyst are pulverized and then mixed with a solvent to prepare a slurry. In some cases, the coal and the catalyst may be firstly mixed with the solvent and then pulverized in oil. The weight ratio of solvent to coal may range from about 0.5 to about 5. In addition to coal, other carbonaceous materials such as a liquefaction residue, coal purified with a solvent, a residue of heavier oils, a vacuum distillation residue from petroleum refining processes and the like may be introduced to the coal liquefaction zone.

The separation zone may comprise a combination of vapor-liquid separation, solid-liquid separation and distillation, although the manner of separation is not critical in the process of this invention. Thus, only vacuum distillation may be employed in this step without solid-liquid separation. The solid-liquid separation, if employed, may be carried out by centrifugal separation, extraction at the critical point according to the Kerr-Mcgee method or gravitational sedimentation.

In the metal bath gasification zone, the liquefaction residue injected into the furnace as at least part of the carbonaceous solid material is subjected to gasification. Coal may also be supplied to the furnace. Perferably, the residue is injected together with oxygen and steam through a non-immersing lance. One or more metals such as Fe, Mo, Ni, Cr and Cu may be added thereto to make up for any loss. Such metals may be added in the form of an alloy or scrap.

Regarding the other operating conditions of the metal bath gasification process, the content of the disclosure of said Japanese Laid-Open Specification No. 89395/1980 is herein incorporated by reference.

While the drawing does not show specifically the means for collecting the fine powder entrained by the gas generated from the metal bath gasification furnace, any conventional equipment such as a bag filter, cyclone or Venturi scrubber may be employed.

In the cases where a wet dust collector is employed, the collected fine powder is preferably dried, after removal of water, and then used as a catalyst.

In the embodiment shown in the drawing, elemental sulfur is added to the fine powder as a catalyst to enhance the catalytic activity. Alternatively, as previously mentioned, the fine powder may be sulfurized, for example, by using the gas produced in the separation zone as overheads. In addition to the recovered fine powder, another catalyst supplied from outside of the system may be added in combination with the recovered fine powder. Also in the illustrated embodiment, a medium-heavier oil (e.g., boiling range of 180°–450° C.) of the resulting coal liquids is used as a solvent. This oil may be hydrogenated, prior to use, in a hydrogenation zone in order to improve its performance. The hydrogenation, if employed, may be carried out in the presence of a catalyst which comprises at least two metals selected from Mo, Ni, Co, W, Cr, etc. A temperature of about 350°–450° C. and a hydrogen pressure of about 50–120 kg/cm$^2$ are conveniently employed. The hydrogen gas used in this hydrogenation zone may be one generated in said gasification zone 4 and then recovered from said gas-purification zone 6.

The following examples are presented as specific illustrations of the claimed invention. It should be understood, however, that the invention is not limited to the specific details set forth in the examples.

EXAMPLE 1

Experiments on coal liquefaction were carried out under the conditions mentioned above. The properties of the coal used are shown in Table 1 and the properties of the catalysts used and the results (% conversion of coal) are summarized in Table 2.

A 5-liter autoclave was used as a liquefaction reactor.

The reaction conditions were as mentioned below. Two types of solvent were used.

Reaction time: 1 hour

Temperature: 450° C.

Pressure: 70 kg/cm$^2$ in initial hydrogen pressure

Solvent: 1000 grams

Solvent A: A mixture of 50% by weight creosote oil and 50% by weight anthracene oil Solvent B: A mixture of 50% by weight creosote oil and 50% by weight anthracene oil which has been hydrogenated at 400° C. for 1 hour under a hydrogen pressure of 100 kg/cm$^2$.

Coal: 500 g

Catalyst: Added in an amount of 10 g as total Fe (atomic Fe basis). All the catalytic components other than sulfur have been pulverized so that at least 80% of the particles range from 100 mesh to 200 mesh.

The percent conversion of coal is defined by the equation:

$$\% \text{ Conversion of coal} = \left\{ 1 - \frac{\text{Grams of benzene-insoluble organics in the autoclave content after reaction*}}{\text{Grams of dry ash-free coal charged}} \right\} \times 100$$

*Grams of benzene-insoluble organics:
The weight in grams of benzene-insoluble matter consisting essentially of organic substances which are free of inorganic substances such as ash and catalytic components.

Thus, the percent conversion of coal is an indication of the degree of progress of the liquefaction reaction, and the higher the percent conversion, the further the reaction has proceeded.

TABLE 1

Properties of coal used

| Petrographical analysis | | Technical analysis (by weight) | | | | | | |
|---|---|---|---|---|---|---|---|---|
| | Active | Dry coal basis | | Dry ash-free coal basis | | | | |
| Average reflectance | components (% by weight) | % Ash | % Voltatiles | C | H | N | O | S |
| 0.36 | 88 | 10 | 44 | 76.6 | 6.3 | 1.1 | 15.6 | 0.4 |

TABLE 2

Properties of catalyst used and percent conversion of coal

| Run No. | Type and amount of catalyst used | Solvent | % Conversion of coal |
|---|---|---|---|
| 1 | None | A | 50 |
| | | B | 72 |
| 2 | Commercially available iron hydroxide (19.8 g) + sulfur (10 g) | A | 69 |
| | | B | 80 |
| 3 | Red mud*1 (35.5 g) + sulfur (10 g) | A | 71 |
| | | B | 85 |
| 4 | Fine powder*2 from metal bath gasification furnace (16.5 g) | A | 72 |
| | | B | 85 |
| 5 | Fine powder from metal bath gasification furnace (16.5 g) + sulfur (10 g) | A | 75 |
| | | B | 91 |
| 6 | Fine powder from metal bath gasification furnace (16.5 g) through which 1% $H_2S$-containing $H_2$ gas has been passed at 400° C. and 60 kg/cm$^2$ for 6 hours | A | 76 |
| | | B | 90 |
| 7 | Fine powder from metal bath gasification furnace (16.5 g) through which 1% $H_2S$-containing $H_2$ gas has been passed at 350° C. and 60 kg/cm$^2$ for 8 hours | A | 75 |
| | | B | 90 |

*1A waste product from an aluminum refinery, which contained 40% $Fe_2O_3$ and 50% $Al_2O_3$.
*2The fine powder which contained 60% Fe on an Fe metal basis was collected by means of a cyclone and a bag filter from a gas generated in a 6 ton-scale iron bath as a metal bath gasification furnace.

It can be seen from Table 2 that the catalyst according to the present invention had significantly improved activity and that further improvement in activity could be obtained by incorporation of sulfur or by reaction with hydrogen sulfide. It can also be seen that a hydrogenated oil as a solvent exhibits improved performance over an unhydrogenated one.

EXAMPLE 2

Experiments on catalyst circulation were carried out by using a coal liquefaction plant having a coal throughput of 1 kg/hr, a 60 kg-scale metal bath and a 10 l-scale vacuum distillation column.

The operating conditions of each type of equipment were as follows:

Coal Liquefaction Plant

Coal used: Identical to that used in Example 1

Reaction time: 1 hour

Temperature: 450° C.

Pressure: 210 kg/cm$^2$ in hydrogen pressure in the reactor

Solvent: A hydrogenated 200°–400° C. fraction of the coal liquefaction product

Solvent/coal ratio: 2

Catalyst: Fine powder recovered by a bag filter from the gas generated in the metal bath mentioned below by blowing thereinto the liquefaction residue along with oxygen and steam through a non-immersing lance at the top of the bath. The fine powder catalyst was added in an amount of 1.5% by weight based on coal.

Vacuum Distillation Column

A distillate boiling at 530° C. or below on a normal pressure basis was recovered as a coal liquefaction product, while the bottom effluent as a liquefaction residue was passed to the metal bath in which it was subjected to gasification.

Metal Bath

The above-mentioned liquefaction residue was blown along with oxygen and steam into the metal bath through a non-immersing lance at the top of the bath. The oxygen was introduced at a pressure of 11 kg/cm$^2$ and a flow rate of 7.1 Nm$^3$/hr, and the steam was introduced at a temperature of 300° C., a pressure of 12 kg/cm$^2$ and a flow rate of 1.15 kg/hr.

The metal bath was an iron alloy bath containing 8.8% Ni, 9.1% Mo and 3.5% C. The temperature of the bath was 1550° C.

In the manner mentioned above, the liquefaction, vacuum distillation and gasification were carried out sequentially in a continuous operation and the following results were obtained after the operation had reached a steady state.

(1) Material Balance of Coal Liquefaction

The following material balance of liquefaction was obtained from the results of distillation of the liquefaction reaction mixture:

Gas: 12% by weight
Water: 12% by weight
Oil (IBP up to 530° C.): 47% by weight
Liquefaction residue: 33% by weight
(The sum of the materials exceeds 100% because of addition of hydrogen)

In the absence of the catalyst, the oil was obtained in a 36% yield. Therefore, the addition of the fine powder increased the oil yield by 11%.

(2) Volume of Gas Generated

The coal liquefaction plant was operated continuously for 24 hours while the coal liquid product was distilled. Thus, 7.2 kg of a liquefaction residue was obtained.

The liquefaction residue was then subjected to gasification in the metal bath for 20 minutes, resulting in the production of 9.4 Nm$^3$ of a gas.

(3) Composition of Gas

The average composition of the gas generated from the metal bath is shown below in molar percentage.

TABLE 3

| CO | $H_2$ | $CO_2$ | $O_2$ | $N_2$ | $CH_4$ |
|---|---|---|---|---|---|
| 71 | 26 | 2.2 | 0.1 | 0.4 | 0.3 |

It can be seen from the above that the gas can satisfactorily be used as a hydrogen-containing gas in the liquefaction step or as a hydrogenating gas in the hydrogenation of the solvent as long as it has been subjected to carbon monoxide conversion reaction to increase its hydrogen content.

(4) Amount and Composition of Catalyst

The gas produced as above entrained 39 g/Nm$^3$ of fine particulate solids. Thus, after the 24-hour continuous run of coal liquefaction, 366 g of fine solids were collected and they could be used as a catalyst in the next run of coal liquefaction. In this manner, recycling of the catalyst was made possible.

The recovered fine solids contained 2% Mo, 3% Ni, 60% Fe and 3% S.

In order to examine the catalytic activity of the solids, they were tested by autoclave experiments in the same manner as described in Example 1. The results are shown in Table 4.

TABLE 4

| Catalyst | Solvent | % Conversion of coal |
|---|---|---|
| Fine solids (16.5 g) | A | 91 |
| | B | 95 |
| Fine solids (16.5 g) which had been packed in a tube reactor of 50 mm inner diameter and treated with a 1% $H_2S$-containing $H_2$ gas at 300° C. for 1 hour | A | 93 |
| | B | 97 |

It is apparent from the above table that the Mo- and Ni- containing fine solids recovered in the gasification step had significantly high activity.

EXAMPLE 3

Coal liquefaction experiments were carried out using a coal liquefaction plant on the scale of 1 kg/hr coal throughput under the following conditions:

Reaction time: 1 hour
Temperature: 450° C.
Pressure: 150 kg/cm$^2$ in hydrogen pressure in the reactor
Solvent: A 200°–400° C. fraction of a coal liquefaction product which had been hydrogenated in a fixed-bed packed with a Mo-Ni-$Al_2O_3$ catalyst.
Solvent/coal ratio: 2
The catalyst was prepared as in the following.

The liquefaction product was subjected to vacuum distillation and the distillation residue was blown along with oxygen (pressure 11 kg/cm$^2$ and flow rate 3 Nm$^3$/hr) and steam (temperature 300° C., pressure 12 kg/cm$^2$ and flow rate 1.2 kg/hr) into a 60 kg-scale molten iron bath (1570° C.) containing 3.2% C, resulting in the formation of an effluent gas comprising 70% CO and 25% $H_2$. The gas was passed through a cyclone and a Venturi scrubber to collect the fine particulate solids contained therein on the order of 50 g/Nm$^3$ and the thus recovered fine solids were used as a catalyst.

A part of the catalyst was sulfurized by reacting it with carbon disulfide under a hydrogen pressure of 30 kg/cm$^2$ in a batch-type autoclave to prepare a sulfurized catalyst.

These catalysts were added in amounts of 2% by weight based on coal.

The catalysts predominantly comprised iron compounds and their total Fe content was around 60%. They were in the form of fine powder particles of about 50$\mu$ in average diameter.

The liquefaction experiments were carried out in the absence of a catalyst, in the presence of the as-recovered fine powder and in the presence of the sulfurized fine powder. Each run was carried out for 8 hours. The results are summarized below in terms of percent conversion of coal which is an indication as defined in Example 1 and is defined by the equation:

$$\% \text{ Conversion of coal} = \left\{ 1 - \frac{\text{Weight of benzene-insoluble organics after the reaction (kg/hr)}}{\text{Weight of dry ash-free coal charged (kg/hr)}} \right\} \times 100$$

TABLE 5

| Catalyst | % Conversion of coal |
|---|---|
| None | 70 |
| As-recovered fine powder | 87 |
| Sulfurized fine powder | 91 |

The above results indicate that fine powder had a significantly high catalytic activity as it was and that its activity was further improved by sulfurization.

The gas generated in the molten iron bath could satisfactorily be used as a hydrogen source in the coal liquefaction or hydrogenation of oil blend.

EXAMPLE 4

Coal liquefaction experiments were carried out using a coal liquefaction plant on the scale of 1 kg/hr coal throughout under the following conditions:

Reaction time: 1 hour

Temperature: 450° C.

Hydrogen pressure: 172 kg/cm$^2$

Solvent: A 200°–400° C. fraction of a coal liquid product which had been hydrogenated in a fixed-bed packed with a Mo-Ni-$Al_2O_3$ catalyst.

Solvent/coal ratio: 2

The catalyst was prepared as follows.

The liquefaction product was subjected to vacuum distillation and the resulting distillation residue was blown into a 60 kg-scale molten copper bath (1120° C., the metallic phase consisting essentially of 3% Fe and 97% Cu) along with oxygen (pressure 9 kg/cm$^2$ and flow rate 3 Nm$^3$/hr) and steam (temperature 300° C., pressure 10 kg/cm$^2$ and flow rate 1.1 kg/hr), thereby generating a gas comprising 60% CO, 3% $CO_2$ and 30% $H_2$ (by volume). The gas was passed through a Venturi scrubber to collect the entrained fine particulate solids, which were employed as a catalyst in this example. A sulfurized catalyst was also prepared by packing the fine powder in an annular furnace and treating it with hydrogen gas containing 3% hydrogen sulfide at 350° C. for 3 hours.

These catalysts were added to coal in amounts of 2% by weight based on coal and they each contained approximately 25% iron and approximately 35% copper.

The liquefaction experiments were carried out in the absence of catalyst, in the presence of the as-recovered fine powder and in the presence of the sulfurized powder and each run was continued for 8 hours as in Example 3. The results are summarized below.

TABLE 6

| Catalyst | % Conversion of coal |
|---|---|
| None | 72 |
| As-recovered fine powder | 89 |
| Sulfurized fine powder | 94 |

The above results indicated that the fine powder exhibited a significantly high catalytic activity and that its activity could be further improved by presulfurization.

What is claimed is:

1. A coal liquefaction process comprising a coal liquefaction step to contact finely divided coal with molecular hydrogen and a solvent in the presence of a catalyst to provide a slurry, and a separation step to separate the resulting slurry into a gaseous component, a liquid component and a solid residue, characterized by further comprising a metal bath gasification step to gasify a carbonaceous solid material by blowing an oxygen gas and said solid residue onto a molten metal bath through a non-immersing lance, and with fine powdery solids which are derived from the molten metal bath and recovered from the generated gas in said metal bath gasification step being introduced to said liquefaction step and used as said catalyst.

2. A coal liquefaction process as defined in claim 1, in which the catalyst of fine powdery solids is added in an amount of 0.01–20% by weight based on the dry coal to the coal to be treated.

3. A coal liquefaction process as defined in claim 2, in which the catalyst of fine powdery solids is added in an amount of 0.1–3% by weight based on the dry coal to the coal to be treated.

4. A coal liquefaction process as defined in claim 1, in which said fine powdery solids recovered from said gas generated in said metal bath gasification step are combined with elemental sulfur or a sulfur-containing compound, and the resulting mixture is used as said catalyst.

5. A coal liquefaction process as defined in claim 4, in which the weight ratio of the sulfur to the fine powdery solids is 0.1–2.0.

6. A coal liquefaction process as defined in claim 1, in which said fine powdery solids are reacted with elemental sulfur or sulfur-containing compound to give a sulfide and the resulting sulfide is used as said catalyst.

7. A coal liquefaction process as defined in claim 6, in which the weight ratio of sulfur to the fine powdery solids is 0.1–2.0.

8. A liquefaction process as defined in claim 6, in which said sulfur-containing compound is a gas recovered from said separation step.

9. A coal liquefaction process as defined in any one of claims 1–8, in which a liquefaction product oil recovered from said liquid component in said separation step is used as at least part of said solvent.

10. A coal liquefaction process as defined in claim 9, in which the liquefaction product oil is a medium heavier oil.

11. A coal liquefaction process as defined in claim 10, in which said medium heavier oil is hydrogenated and then is used as at least part of said solvent.

12. A coal liquefaction process as defined in any one of claims 1–8, in which steam is injected into the molten metal bath along with said solid residue and oxygen gas.

13. A coal liquefaction process as defined in claim 12, in which hydrogen is recovered from the gas separated in said gasification step, and said molecular hydrogen is the one recovered by refining said hydrogen gas.

14. A coal liquefaction process as defined in claim 12, in which the hydrogenation is carried out by using hydrogen gas which recovered by refining the gas generated in said gasification step.

15. A coal liquefaction process as defined in any one of claims 1–8, in which said molten metal bath is a molten iron bath or a molten steel bath.

16. A coal liquefaction process as defined in claim 15, in which said iron or steel molten bath contains at least one of Cr, Mo, Ni, Co and Cu.

17. A coal liquefaction process as defined in any one of claims 1–8, in which said molten metal bath is a molten copper bath.

* * * * *